US009534179B2

(12) United States Patent
Koseoglu

(10) Patent No.: US 9,534,179 B2
(45) Date of Patent: Jan. 3, 2017

(54) HYDROCRACKING PROCESS WITH FEED/BOTTOMS TREATMENT

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/469,905

(22) Filed: Aug. 27, 2014

(65) Prior Publication Data

US 2014/0360918 A1 Dec. 11, 2014

Related U.S. Application Data

(63) Continuation of application No. 13/012,353, filed on Jan. 24, 2011, now Pat. No. 8,828,219.

(51) Int. Cl.
*C10G 67/14* (2006.01)
*C10G 67/06* (2006.01)

(52) U.S. Cl.
CPC ..... *C10G 67/14* (2013.01); *C10G 67/06* (2013.01); *C10G 2300/1074* (2013.01);
(Continued)

(58) Field of Classification Search
CPC ..... C10G 67/14; C10G 67/06; C10G 2300/44; C10G 2300/1074; C10G 2300/701; C10G 2300/1096; C10G 2300/4081; C10G 2300/202
(Continued)

(56) References Cited

U.S. PATENT DOCUMENTS 4,431,523 A 2/1984 Tabler et al.
4,447,315 A 5/1984 Lamb et al.
(Continued)

FOREIGN PATENT DOCUMENTS

JP 2000178566 A 6/2000

OTHER PUBLICATIONS

PCT/US2012/022302, International Search Report and Written Opinion, May 10, 2012, 7 pages.

*Primary Examiner* — Randy Boyer
*Assistant Examiner* — Juan Valencia
(74) *Attorney, Agent, or Firm* — Abelman, Frayne & Schwab

(57) ABSTRACT

A hydrocracking process is provided for treating a first heavy hydrocarbon feedstream and a second heavy hydrocarbon feedstream, in which the first heavy hydrocarbon feedstream contains undesired nitrogen-containing compounds, sulfur-containing compounds and poly-nuclear aromatic compounds. The first heavy hydrocarbon feedstream is contacted with adsorbent material to produce a treated heavy hydrocarbon stream. The second heavy hydrocarbon feedstream is combined with the treated heavy hydrocarbon stream, and this combined stream is charged to a hydrocracking reaction unit. The hydrocracked effluent is fractioned to recover hydrocracked products and a bottoms stream containing heavy poly-nuclear aromatic compounds. Fractionator bottoms are also contacted with adsorbent material to produce an adsorbent-treated fractionator bottoms stream having a reduced content of heavy poly-nuclear aromatic compounds, and are recycled to the hydrocracking reaction unit.

18 Claims, 3 Drawing Sheets

(52) U.S. Cl.
CPC ..... *C10G 2300/1096* (2013.01); *C10G 2300/202* (2013.01); *C10G 2300/4081* (2013.01); *C10G 2300/44* (2013.01); *C10G 2300/701* (2013.01)

(58) Field of Classification Search
USPC ..... 208/91, 110
See application file for complete search history.

(56) References Cited

U.S. PATENT DOCUMENTS

| | | | | |
|---|---|---|---|---|
| 4,551,229 | A | 11/1985 | Pecoraro et al. | |
| 4,655,903 | A | 4/1987 | Rahbe et al. | |
| 4,775,460 | A | 10/1988 | Reno | |
| 4,846,962 | A * | 7/1989 | Yao | 208/301 |
| 4,931,165 | A | 6/1990 | Kalnes | |
| 4,954,242 | A | 9/1990 | Gruia | |
| 5,007,998 | A | 4/1991 | Gruia | |
| 5,098,994 | A | 3/1992 | Hedrick | |
| 5,139,644 | A | 8/1992 | Gruia | |
| 5,145,574 | A | 9/1992 | Hedrick | |
| 5,190,633 | A * | 3/1993 | Fetzer | C10G 67/06 208/310 R |
| 7,566,394 | B2 | 7/2009 | Koseoglu | |
| 7,763,163 | B2 | 7/2010 | Koseoglu | |
| 2005/0075528 | A1 | 4/2005 | Burkhardt et al. | |
| 2006/0213809 | A1 * | 9/2006 | Barthelet et al. | 208/120.1 |
| 2006/0283776 | A1 | 12/2006 | Iqbal | |
| 2008/0105595 | A1 * | 5/2008 | Koseoglu | 208/91 |
| 2009/0156876 | A1 | 6/2009 | Ou et al. | |
| 2010/0252483 | A1 | 10/2010 | Koseoglu | |

* cited by examiner

HYDROCRACKING PROCESS WITH FEED/BOTTOMS TREATMENT

RELATED APPLICATIONS

This application is a continuation application of U.S. patent application Ser. No. 13/012,353 filed on Jan. 24, 2011, which is incorporated herein by reference in its entirety.

BACKGROUND OF THE INVENTION

Field of the Invention

The present invention relates to hydrocracking processes, and in particular to hydrocracking processes adapted to receive multiple feedstreams.

Description of Related Art

Hydrocracking processes are used commercially in a large number of petroleum refineries. They are used to process a variety of feeds boiling in the range of 370° C. to 520° C. in conventional hydrocracking units and boiling at 520° C. and above in the residue hydrocracking units. In general, hydrocracking processes split the molecules of the feed into smaller, i.e., lighter, molecules having higher average volatility and economic value. Additionally, hydrocracking processes typically improve the quality of the hydrocarbon feedstock by increasing the hydrogen to carbon ratio and by removing organosulfur and organonitrogen compounds. The significant economic benefit derived from hydrocracking processes has resulted in substantial development of process improvements and more active catalysts.

In addition to sulfur-containing and nitrogen-containing compounds, a typical hydrocracking feedstream, such as vacuum gas oil (VGO), contains small amount of poly nuclear aromatic (PNA) compounds, i.e., those containing less than seven fused benzene rings. As the feedstream is subjected to hydroprocessing at elevated temperature and pressure, heavy poly nuclear aromatic (HPNA) compounds, i.e., those containing seven or more fused benzene rings, tend to form and are present in high concentration in the unconverted hydrocracker bottoms.

Heavy feedstreams such as de-metalized oil (DMO) or de-asphalted oil (DAO) have much higher concentration of nitrogen, sulfur and PNA compounds than VGO feedstreams. These impurities can lower the overall efficiency of hydrocracking unit by requiring higher operating temperature, higher hydrogen partial pressure or additional reactor/catalyst volume. In addition, high concentrations of impurities can accelerate catalyst deactivation.

Three major hydrocracking process schemes include single-stage once through hydrocracking, series-flow hydrocracking with or without recycle, and two-stage recycle hydrocracking. Single-stage once through hydrocracking is the simplest of the hydrocracker configuration and typically occurs at operating conditions that are more severe than hydrotreating processes, and less severe than conventional full pressure hydrocracking processes. It uses one or more reactors for both treating steps and cracking reaction, so the catalyst must be capable of both hydrotreating and hydrocracking. This configuration is cost effective, but typically results in relatively low product yields (e.g., a maximum conversion rate of about 60%). Single stage hydrocracking is often designed to maximize mid-distillate yield over a single or dual catalyst systems. Dual catalyst systems are used in a stacked-bed configuration or in two different reactors. The effluents are passed to a fractionator column to separate the $H_2S$, $NH_3$, light gases ($C_1$-$C_4$), naphtha and diesel products boiling in the temperature range of 36-370° C. The hydrocarbons boiling above 370° C. are unconverted bottoms that, in single stage systems, are passed to other refinery operations.

Series-flow hydrocracking with or without recycle is one of the most commonly used configuration. It uses one reactor (containing both treating and cracking catalysts) or two or more reactors for both treating and cracking reaction steps. Unconverted bottoms from the fractionator column are recycled back into the first reactor for further cracking. This configuration converts heavy crude oil fractions, i.e., vacuum gas oil, into light products and has the potential to maximize the yield of naphtha, jet fuel, or diesel, depending on the recycle cut point used in the distillation section.

Two-stage recycle hydrocracking uses two reactors and unconverted bottoms from the fractionation column are recycled back into the second reactor for further cracking. Since the first reactor accomplishes both hydrotreating and hydrocracking, the feed to second reactor is virtually free of ammonia and hydrogen sulfide. This permits the use of high performance zeolite catalysts which are susceptible to poisoning by sulfur or nitrogen compounds.

A typical hydrocracking feedstock is vacuum gas oils boiling in the nominal range of 370° C. to 520° C. DMO or DAO can be blended with vacuum gas oil or used as is and processed in a hydrocracking unit. For instance, a typical hydrocracking unit processes vacuum gas oils that contain from 10V % to 25V % of DMO or DAO for optimum operation. 100% DMO or DAO can also be processed for difficult operations. However, the DMO or DAO stream contains significantly more nitrogen compounds (2,000 ppmw vs. 1,000 ppmw) and a higher micro carbon residue (MCR) content than the VGO stream (10 W % vs.<1 W %).

The DMO or DAO in the blended feedstock to the hydrocracking unit can have the effect of lowering the overall efficiency of the unit, i.e., by causing higher operating temperature or reactor/catalyst volume requirements for existing units or higher hydrogen partial pressure requirements or additional reactor/catalyst volume for the grass-roots units. These impurities can also reduce the quality of the desired intermediate hydrocarbon products in the hydrocracking effluent. When DMO or DAO are processed in a hydrocracker, further processing of hydrocracking reactor effluents may be required to meet the refinery fuel specifications, depending upon the refinery configuration. When the hydrocracking unit is operating in its desired mode, that is to say, producing products in good quality, its effluent can be utilized in blending and to produce gasoline, kerosene and diesel fuel to meet established fuel specifications.

In addition, formation of HPNA compounds is an undesirable side reaction that occurs in recycle hydrocrackers. The HPNA molecules form by dehydrogenation of larger hydro-aromatic molecules or cyclization of side chains onto existing HPNAs followed by dehydrogenation, which is favored as the reaction temperature increases. HPNA formation depends on many known factors including the type of feedstock, catalyst selection, process configuration, and operating conditions. Since HPNAs accumulate in the recycle system and then cause equipment fouling, HPNA formation must be controlled in the hydrocracking process.

Lamb, et al. U.S. Pat. No. 4,447,315 discloses a single-stage recycle hydrocracking process in which unconverted bottoms are contacted with an adsorbent to remove PNA compounds. Unconverted bottoms having a reduced concentration of PNA compounds are recycled to the hydrocracking reactor.

Gruia U.S. Pat. No. 4,954,242 describes a single-stage recycle hydrocracking process in which an HPNA containing heavy fraction from a vapor-liquid separator downstream of a hydrocracking reactor is contacted with an adsorbent in an adsorption zone. The reduced HPNA heavy fraction is then either recycled to the hydrotreating zone or introduced directly into the fractionation zone.

Commonly-owned U.S. Pat. No. 7,763,163 discloses adsorption of a DMO or DAO feedstream to a hydrocracker unit to remove nitrogen-containing compounds, sulfur-containing compounds and PNA compounds. This process is effective for removal of impurities including nitrogen-containing compounds, sulfur-containing compounds and PNA compounds from the DMO or DAO feedstock to the hydrocracker unit. A separate VGO feedstock is also shown as a feed to the hydrocracker reactor along with the cleaned DMO or DAO feed. However, a relatively high concentration of HPNA compounds remains in unconverted hydrocracker bottoms.

While the above-mentioned references are suitable for their intended purposes, a need remains for improved process and apparatus for efficient and efficacious hydrocracking of heavy oil fraction feedstocks.

SUMMARY OF THE INVENTION

In accordance with one or more embodiments, a hydrocracking process is provided for treating a first heavy hydrocarbon feedstream and a second heavy hydrocarbon feedstream, in which the first heavy hydrocarbon feedstream contains undesired nitrogen-containing compounds, sulfur-containing compounds and PNA compounds. The process includes the following steps:

a. contacting the first heavy hydrocarbon feedstream with an effective amount of adsorbent material to produce an adsorbent-treated heavy hydrocarbon stream having a reduced content of nitrogen-containing, sulfur-containing compounds and PNA compounds;

b. combining the second heavy hydrocarbon feedstream with the adsorbent-treated heavy hydrocarbon stream;

c. introducing the combined stream and an effective amount of hydrogen into a hydrocracking reaction unit that contains an effective amount of hydrocracking catalyst to produce a hydrocracked effluent stream;

d. fractionating the hydrocracked effluent stream to recover hydrocracked products and a bottoms stream containing HPNA compounds;

e. contacting the fractionator bottoms stream with an effective amount of adsorbent material to produce an adsorbent-treated fractionator bottoms stream having a reduced content of heavy poly-nuclear aromatic compounds;

f. integrating the adsorbent-treated fractionator bottoms stream with the combined stream of steps (b); and g. introducing the combined stream into the hydrocracking unit.

BRIEF DESCRIPTION OF THE DRAWINGS

The foregoing summary as well as the following detailed description of preferred embodiments of the invention will be best understood when read in conjunction with the attached drawings. For the purpose of illustrating the invention, there are shown in the drawings embodiments which are presently preferred. It should be understood, however, that the invention is not limited to the precise arrangements and apparatus shown, in the drawings, in which.

DETAILED DESCRIPTION OF THE INVENTION

Integrated processes and apparatus are provided for hydrocracking hydrocarbon feeds, such as a combined feed of VGO and DMO and/or DAO, in an efficient manner and resulting in improved product quality. The presence of nitrogen-containing compounds, sulfur-containing compounds and PNA compounds in DMO or DAO feedstreams, and the presence of HPNA compounds in hydrocracker bottoms, have detrimental effects on the performance of hydrocracking unit. The integrated processes and apparatus provided herein remove or reduce the concentration of nitrogen-containing compounds, sulfur-containing compounds, PNA compounds and HPNA compounds to thereby improve process efficiency and the effluent product quality.

In general, the processes for improved cracking includes contacting a first heavy hydrocarbon feedstream and a hydrocracking reaction bottoms stream, with an effective quantity of adsorbent material in which nitrogen-containing compounds, sulfur-containing compounds, PNA compounds and HPNA compounds are removed. The adsorbent effluent, which generally contains about 85 V % to about 95 V % of the first heavy hydrocarbon feedstream and about 10 V % to about 60 V %, in certain embodiments about 20 V % to about 50 V %, and in further embodiments about 30 V % to about 40 V % of the hydrocracking reaction bottoms stream (i.e., the recycle stream), is combined with a second hydrocarbon feedstream and cracked in the presence of hydrogen in a hydrocracking reaction zone. Excess hydrogen is separated from hydrocracking effluent and recycled back to the hydrocracking reaction zone. The remainder of the hydrocracking effluent is fractionated, and the hydrocracking reaction bottoms stream is contacted with adsorbent material as noted above.

Figure 1:
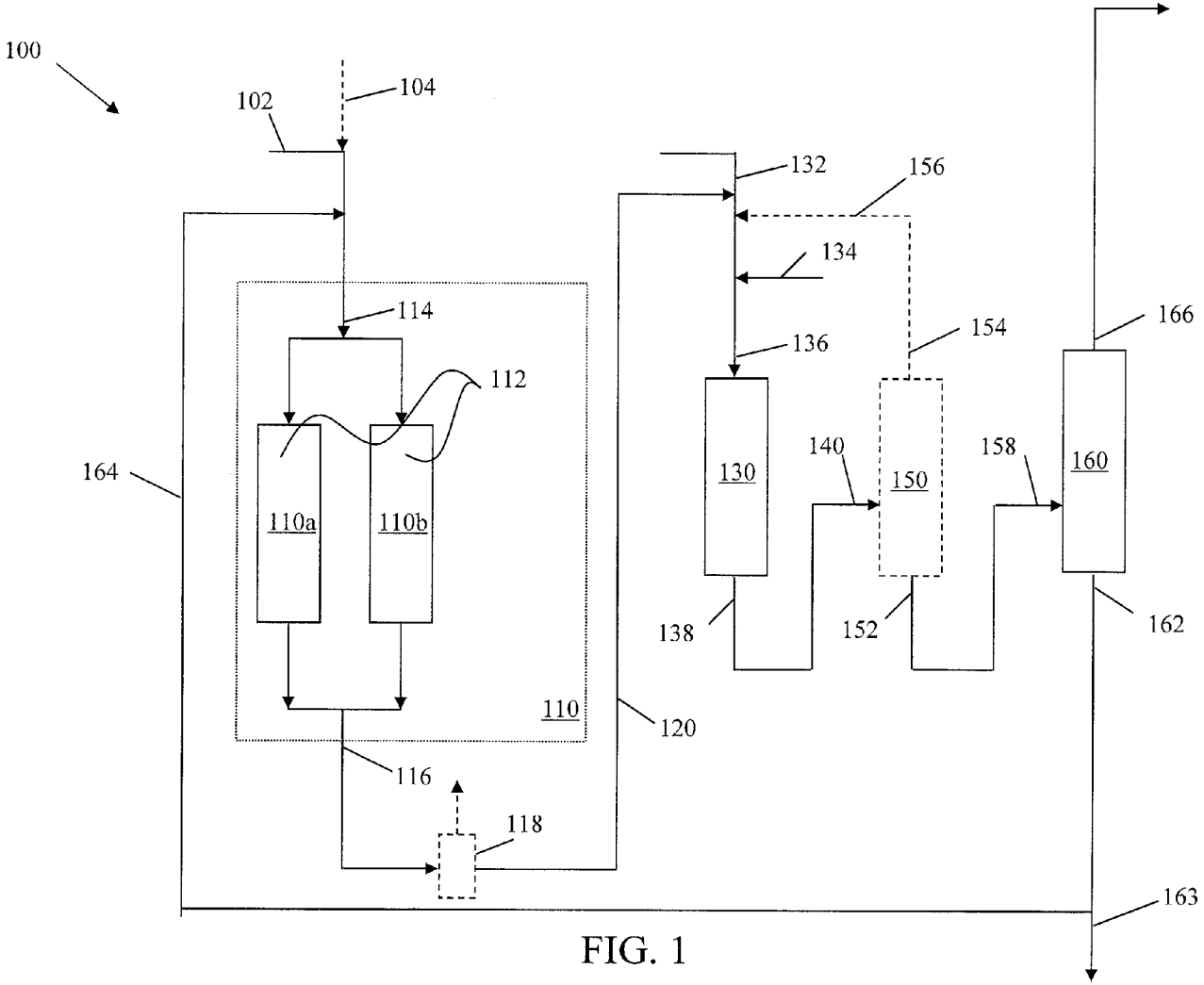
FIG. 1 is a process flow diagram of an integrated hydrocracking process with feed/bottoms pretreatment.

In particular, and referring to FIG. 1, a process flow diagram of an integrated hydrocracking apparatus 100 including feed/bottoms treatment is provided. Apparatus 100 includes an adsorption zone 110, a hydrocracking reaction zone 130 containing hydrocracking catalysts, an optional high-pressure separation zone 150, and a fractionating zone 160.

Adsorption zone 110 includes an inlet 114 in fluid communication with a source of a first heavy hydrocarbon feedstream via a conduit 102, and hydrocracking reaction product fractionator bottoms via a conduit 164, which is in fluid communication with an unconverted/partially converted fractionator bottoms outlet 162 of fractionating zone 160. Optionally, inlet 114 of adsorption zone 110 is also in fluid communication with a source of elution solvent via conduit 104, for instance, straight run naphtha which can be derived from the product collected from the fractionating zone 160 or from another source of solvent. In addition, adsorption zone 110 includes a cleaned feedstream outlet 116 in fluid communication with an inlet 136 of hydrocracking reaction zone 130 via a conduit 120. In embodiments in which a solvent elution stream is employed, the solvent can be distilled off, for instance, at an optional fractionator 118 between the cleaned feedstream outlet 116 and the inlet 136 of hydrocracking reaction zone 130.

Feed inlet 136 of hydrocracking zone 130 is also in fluid communication a source of second heavy hydrocarbon feedstream via a conduit 132. In addition, inlet 136 is in fluid communication with a source of hydrogen via a conduit 134 and optionally a hydrogen recycle stream from outlet 154 of high-pressure separation zone 150 via a conduit 156, e.g., if there is an excess of hydrogen to be recovered. An outlet 138 of hydrocracking reaction zone 130 is in fluid communication with an inlet 140 of high-pressure separation zone 150. In embodiments in which there is not an excess of hydrogen to be recovered, i.e., stoichiometric or near-stoichiometric hydrogen feed is provided, high pressure separation zone 150 can be bypasses or eliminated, and outlet 138 of hydrocracking reaction zone 130 is in fluid communication with inlet 158 of the fractionating zone 160.

High-pressure separation zone 150 includes an outlet 152 in fluid communication with an inlet 158 of the fractionating zone 160 for conveying cracked, partially cracked and unconverted hydrocarbons, and an outlet 154 in fluid communication with inlet 136 of the hydrocracking reaction zone 130 for conveying recycle hydrogen. Fractionating zone 160 further includes outlet 162 in fluid communication with inlet 114 of adsorption zone 110 and a bleed outlet 163, and an outlet 166 to discharge cracked product.

In operation of the system 100, a combined stream including a first heavy hydrocarbon feedstream via conduit 102 and a hydrocracking reaction bottoms stream via conduit 164, and optionally solvent via conduit 104 from fractionating zone 160 or from another source, are introduced into the adsorption zone 110 via inlet 114. Solvent can be optionally used to facilitate elution of the feedstock mixture over the adsorbent. The concentrations of nitrogen-containing compounds, sulfur-containing compounds and PNA compounds present in the in the first heavy hydrocarbon feedstream, and HPNA compounds from the hydrocracking reaction bottoms stream, are reduced in the adsorption zone 110 by contact with adsorbent 112.

An adsorbent-treated hydrocracking feedstream is discharged from adsorption zone 110 via outlet 116 and conveyed to inlet 136 of hydrocracking reaction zone 130 via and conduit 120, along with the second hydrocarbon feedstream which is introduced into inlet 136 of hydrocracking reaction zone 130 via conduit 132. In embodiments in which elution solvent is utilized, it is distilled and recovered in fractionator 118.

An effective quantity of hydrogen for hydrocracking reactions is provided via conduits 134 and optionally recycle hydrogen conduit 156. Hydrocracking reaction effluents are discharged from outlet 138 of hydrocracking reaction zone 130. When an excess of hydrogen is used, the hydrocracking reaction effluents are conveyed to inlet 140 of high-pressure separation zone 150. A gas stream, which mainly contains hydrogen, is separated from the converted, partially converted and unconverted hydrocarbons in the high-pressure separation zone 150, and is discharged via outlet 154 and recycled to hydrocracking reaction zone 130 via conduit 156. Converted, partially converted and unconverted hydrocarbons, which includes HPNA compounds formed in the hydrocracking reaction zone 130, are discharged via outlet 152 to inlet 158 of fractionating zone 160. A cracked product stream is discharged via outlet 166 and can be further processed and/or blended in downstream refinery operations to produce gasoline, kerosene and/or diesel fuel. At least a portion of the fractionator bottoms from the hydrocracking reaction effluent, including HPNA compounds formed in the hydrocracking reaction zone 130, are discharged from outlet 162 and are recycled to adsorption zone 110 via conduit 164. A portion of the fractionator bottoms from the hydrocracking reaction effluent is removed from bleed outlet 163 to remove a portion of the HPNA compounds, which could causes equipment fouling. The concentration of HPNA compounds in the hydrocracking effluent fractionator bottoms is reduced in adsorption zone 110. In particular, in system 100, both the hydrocracking reaction fractionator bottoms and the first heavy hydrocarbon feedstream are combined and contacted with adsorbent material 112 in adsorption zone 110. The adsorbent-treated hydrocracking feed is combined with the second heavy hydrocarbon feedstream for cracking in the hydrocracking reaction zone 130.

In certain embodiments, the adsorption zone includes columns that are operated in swing mode so that production of the cleaned feedstock is continuous. When the adsorbent material 112 in column 110*a* or 110*b* becomes saturated with adsorbed nitrogen-containing compounds, sulfur-containing compounds, PNA compounds and/or HPNA compounds, the flow of the combined feedstream is directed to the other column. The adsorbed compounds are desorbed by heat or solvent treatment.

In case of heat desorption, heat is applied, for instance, with an inert nitrogen gas flow to adsorption zone 110. The desorbed compounds are removed from the adsorption columns 110*a*, 110*b* via a suitable outlet (not shown) and can be conveyed to downstream refinery processes, such as residue upgrading facilities, or is used directly in fuel oil blending.

Figure 2:
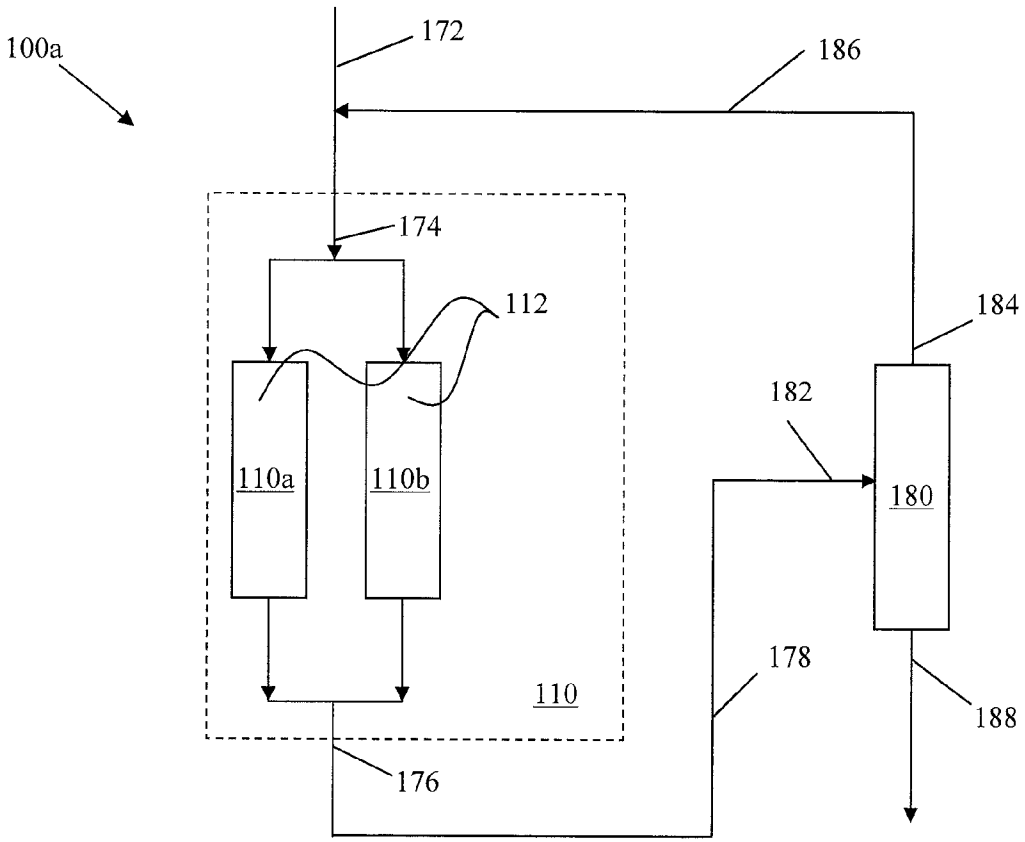
FIG. 2 is a process flow diagram of an embodiment of a desorption apparatus.

Referring to FIG. 2, a flow diagram of a solvent desorption apparatus 100*a* is provided. A solvent inlet 174 of adsorption zone 110 is in fluid communication with a source of fresh solvent via a conduit 172 and recycled solvent via a conduit 186. Adsorption zone 110 further includes an outlet 176 in fluid communication with an inlet 182 of a desorption fractionating zone 180 via a conduit 178. A solvent outlet 184 of desorption fractionating zone 180 is in fluid communication with the adsorption zone inlet 174 via a conduit 186, and a bottoms outlet 188 is provided to discharge the desorbed nitrogen-containing compounds, sulfur-containing compounds, PNA compounds and/or HPNA compounds.

In one embodiment, fresh solvent is introduced to the adsorption zone 110 via conduit 172 and inlet 174. The solvent stream containing removed nitrogen-containing compounds, sulfur-containing compounds, PNA compounds and/or HPNA compounds is discharged from adsorption zone 110 via outlet 176 and conveyed via conduit 178 to inlet 182 of fractionation unit 180. The recovered solvent stream is recycled back to adsorption zone 110 via outlet 184 and conduit 186. The bottoms stream from the fractionation unit 180 containing the previously adsorbed nitrogen-containing compounds, sulfur-containing compounds, PNA compounds and/or HPNA compounds is discharged via outlet 188 and can be conveyed to downstream refinery processes, such as residue upgrading facilities, or is used directly in fuel oil blending.

Figure 3:
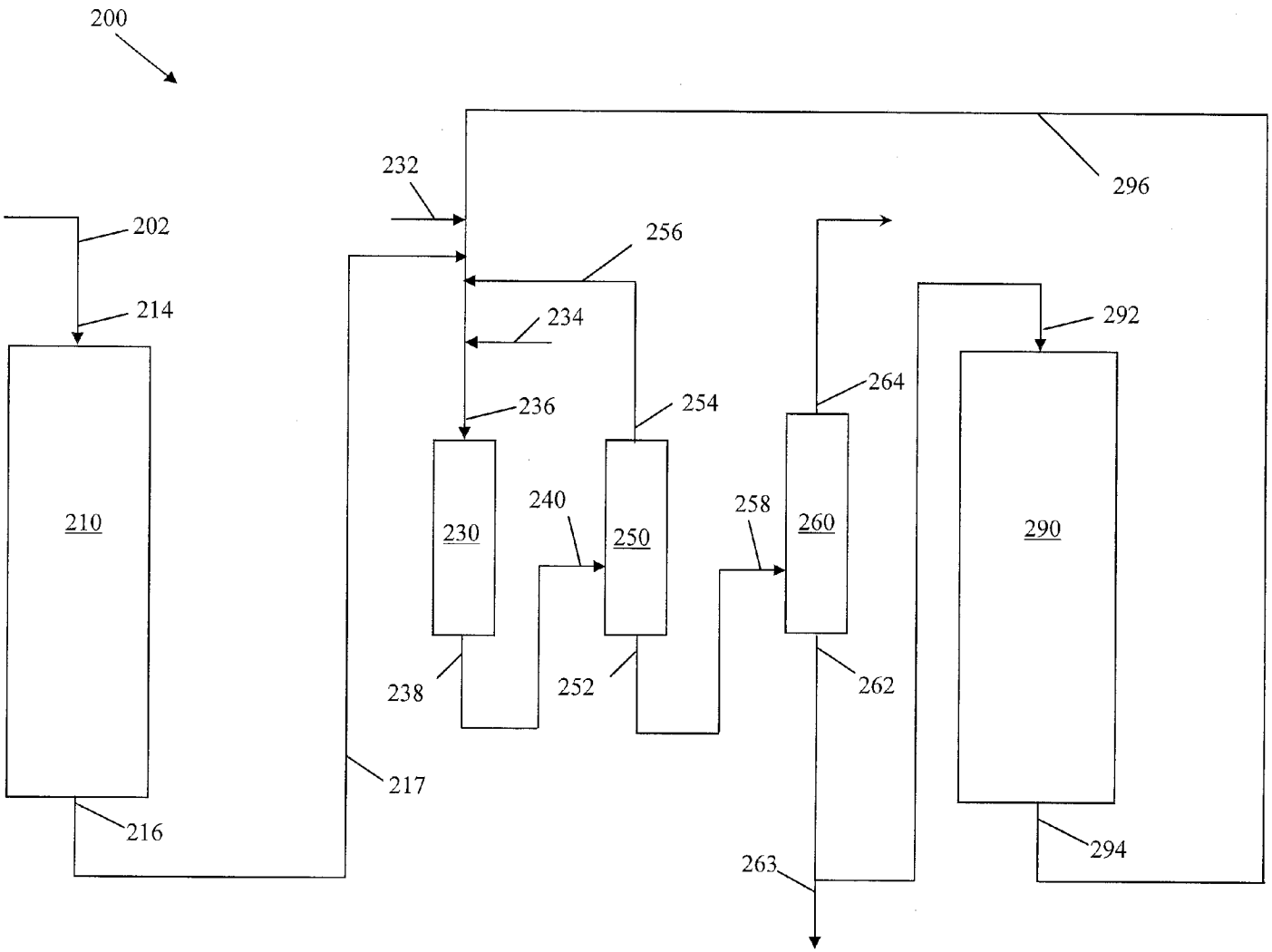
FIG. 3 is a process flow diagram of an integrated hydrocracking process with separate feed and bottoms treatments.

Referring to FIG. 3, a process flow diagram of an integrated hydrocracking apparatus 200 including feed pretreatment and bottoms treatment is provided. Apparatus 200 includes a first adsorption zone 210, a hydrocracking reaction zone 230 containing hydrocracking catalysts, a high-pressure separation zone 250, a fractionating zone 260, and a second adsorption zone 290.

First adsorption zone 210 includes an inlet 214 in fluid communication with a source of first heavy hydrocarbon feedstream via a conduit 202 (and optionally a source of solvent as described with respect to FIG. 1, not shown in FIG. 3), and a cleaned feedstream outlet 216 in fluid communication with an inlet 236 of hydrocracking reaction zone 230 via a conduit 217.

Feed inlet 236 of hydrocracking reaction zone 230 is also in fluid communication with a source of second hydrocarbon feedstream via a conduit 232. In addition, inlet 236 is in fluid communication with a source of hydrogen via a conduit 234 and hydrogen recycle stream from outlet 254 of high-pressure separation zone 250 via a conduit 256. As noted with respect to the discussion of apparatus 100 in FIG. 1, the high pressure separation zone can be bypasses or eliminated, for instance, if there is little or no excess hydrogen. Hydrocracking reaction zone 230 includes an outlet 238 in fluid communication with an inlet 240 of high-pressure separation zone 250.

High-pressure separation zone 250 also includes an outlet 252 in fluid communication with an inlet 258 of fractionating zone 260 for conveying cracked, partially cracked and unconverted hydrocarbons, and an outlet 254 in fluid communication with the hydrocracking reaction zone 230 for conveying recycle hydrogen. Fractionating zone 260 further includes outlet 262 in fluid communication with inlet 292 of second adsorption zone 290, and an outlet 264 to discharge cracked product.

Second adsorption zone 290 includes inlet 292 in fluid communication with fractionating zone outlet 262 (and optionally a source of solvent as described with respect to FIG. 1, not shown in FIG. 3), and an outlet 294 in fluid communication with inlet 236 of hydrocracking reaction zone 230 via a conduit 296.

In operation of the system 200, a first heavy hydrocarbon feedstream is conveyed via conduit 202 to inlet 214 of first adsorption zone 210. The concentrations of nitrogen-containing compounds, sulfur-containing compounds and PNA compounds in the first heavy hydrocarbon feedstream are reduced in first adsorption zone 210.

An adsorbent-treated first heavy hydrocarbon feedstream is discharged from outlet 216 of adsorption zone 210 and conveyed to inlet 236 of hydrocracking reaction zone 230 via conduit 217. A second hydrocarbon feedstream is also introduced into the hydrocracking reaction zone 230 via conduit 232. An effective quantity of hydrogen for hydrocracking reactions is provided via conduits 234, 256. Hydrocracked effluents are discharged via outlet 238 to inlet 240 of high-pressure separation zone 250. A gas stream, which primarily contains hydrogen, is separated from the converted, partially converted and unconverted hydrocarbons in the high-pressure separation zone 250, and is discharged via outlet 254 and recycled to hydrocracking reaction zone 230 via conduit 256. Converted, partially converted and unconverted hydrocarbons, including HPNA compounds formed in the hydrocracking reaction zone 230, are discharged via outlet 252 to inlet 258 of fractionating zone 260. A cracked product stream is discharged via outlet 264 and can be further processed and/or blended in downstream refinery operations to produce gasoline, kerosene and/or diesel fuel. Unconverted and partially cracked fractionator bottoms, including HPNA compounds formed in the hydrocracking reaction zone 230, are discharged from outlet 262 and at least a portion thereof is conveyed to inlet 292 of second adsorption zone 290, with the remainder removed via a bleed outlet 263. The concentration of HPNA compounds in the unconverted fractionator bottoms is reduced in the second adsorption zone 290, therefore improving the quality of the recycle stream. Adsorbent-treated unconverted fractionator bottoms are sent to the hydrocracking reaction zone 230 via outlet 294 in fluid communication with inlet 236 for further cracking.

By employing distinct adsorption zones 210, 290, the content of the individual feeds to these adsorption zones can be specifically targeted. That is, nitrogen-containing compounds, sulfur-containing compounds and PNA compounds from the initial feed can be removed in the first adsorption zone 210 under a first set of operating conditions and using a first adsorbent material, and HPNA compounds formed during the hydrocracking process can be removed in the second adsorption zone 290 under a second set of operating conditions and using a second adsorbent material.

The feedstreams for use in above-described system and process can be a partially refined oil product obtained from various sources. In general, the first heavy feedstream is one or more of DMO from a solvent demetalizing operations or DAO from a solvent deasphalting operations, coker gas oils from coker operations, heavy cycle oils from fluid catalytic cracking operations, and visbroken oils from visbreaking operations. The first heavy feedstream generally has a boiling point of from about 450° C. to about 800° C., and in certain embodiments of from about 500° C. to about 700° C.

The second heavy hydrocarbon feedstream is generally VGO from a vacuum distillation operation, and contains hydrocarbons having a boiling point of from about 350° C. to about 600° C., and in certain embodiments from about 350° C. to about 570° C.

Suitable reaction apparatus for the hydrocracking reaction zone include fixed bed reactors, moving bed reactor, ebullated bed reactors, baffle-equipped slurry bath reactors, stirring bath reactors, rotary tube reactors, slurry bed reactors, or other suitable reaction apparatus as appreciated by one of ordinary skill in the art. In certain embodiments, and in particular for VGO and similar feedstreams, fixed bed reactors are utilized. In additional embodiments, and in particular for heavier feedstreams and other difficult to crack feedstreams, ebullated bed reactors are utilized.

In general, the operating conditions for the reactor of a hydrocracking zone include: reaction temperature of about 300° C. to about 500° C., in certain embodiments about 330° C. to about 475° C., and in further embodiments about 330° C. to about 450° C.; hydrogen partial pressure of about 60 $Kg/cm^2$ to about 300 $Kg/cm^2$, in certain embodiments about 100 $Kg/cm^2$ to about 200 $Kg/cm^2$, and in further embodiments about 130 $Kg/cm^2$ to about 180 $Kg/cm^2$; liquid hourly space velocity of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$; hydrogen/oil ratio of about 500 normalized $m^3$ per $m^3$ ($Nm^3/m^3$) to about 2500 $Nm^3/m^3$, in certain embodiments about 800 $Nm^3/m^3$ to about 2000 $Nm^3/m^3$, and in further embodiments about 1000 $Nm^3/m^3$ to about 1500 $Nm^3/m^3$.

In certain embodiments, the hydrocracking catalyst includes any one of or combination including amorphous alumina catalysts, amorphous silica alumina catalysts, natural or synthetic zeolite based catalyst, or a combination thereof. The hydrocracking catalyst can possess an active phase material including, in certain embodiments, any one of or combination including Ni, W, Mo, or Co. In certain embodiments in which an objective is hydrodenitrogenation, acidic alumina or silica alumina based catalysts loaded with Ni—Mo or Ni—W active metals, or combinations thereof, are used. In embodiments in which the objective is to remove all nitrogen and to increase the conversion of hydrocarbons, silica alumina, zeolite or combination thereof are used as catalysts, with active metals including Ni—Mo, Ni—W or combinations thereof.

The adsorption zone(s) used in the process and apparatus described herein is, in certain embodiments, at least two packed bed columns which are gravity fed or pressure force-fed sequentially in order to permit continuous operation when one bed is being regenerated, i.e., swing mode operation. The columns contain an effective quantity of absorbent material, such as attapulgus clay, alumina, silica gel silica-alumina, fresh or spent catalysts, or activated carbon. The packing can be in the form of pellets, spheres, extrudates or natural shapes, having a size of about 4 mesh to about 60 mesh, and in certain embodiments about 4 mesh to about 20 mesh, based on United States Standard Sieve Series.

The packed columns are generally operated at a pressure in the range of from about 1 $kg/cm^2$ to about 30 $kg/cm^2$, in certain embodiments about 1 $kg/cm^2$ to about 20 $kg/cm^2$, and in further embodiments about 1 $kg/cm^2$ to about 10 $kg/cm^2$, a temperature in the range of from about 20° C. to about 250° C., in certain embodiments about 20° C. to about 150° C., and in further embodiments about 20° C. to about 100° C.; and a liquid hourly space velocity of about 0.1 $h^{-1}$ to about 10 $h^{-1}$, in certain embodiments about 0.25 $h^{-1}$ to about 5 $h^{-1}$, and in further embodiments about 0.5 $h^{-1}$ to about 2 $h^{-1}$. The adsorbent can be desorbed by applying heat via inert nitrogen gas flow introduced at a pressure of from about 1 $kg/cm^2$ to about 30 $kg/cm^2$, in certain embodiments about 1 $kg/cm^2$ to about 20 $kg/cm^2$, and in further embodiments about 1 $kg/cm^2$ to about 10 $kg/cm^2$.

In embodiments in which the adsorbent is desorbed by solvent desorption, solvents can be selected based on their Hildebrand solubility factors or by their two-dimensional solubility factors. Solvents can be introduced at a solvent to oil volume ratio of about 1:1 to about 10:1.

The overall Hildebrand solubility parameter is a well-known measure of polarity and has been calculated for numerous compounds. See *The Journal of Paint Technology*, Vol. 39, No. 505 (February 1967). The solvents can also be described by their two-dimensional solubility parameter. See, for example, I. A. Wiehe, *Ind. & Eng. Res.*, 34(1995), 661. The complexing solubility parameter component, which describes the hydrogen bonding and electron donor acceptor interactions, measures the interaction energy that requires a specific orientation between an atom of one molecule and a second atom of a different molecule. The field force solubility parameter, which describes the van der Waals and dipole interactions, measures the interaction energy of the liquid that is not destroyed by changes in the orientation of the molecules.

In accordance with the desportion operations using a non-polar solvent or solvents (if more than one is employed) preferably have an overall Hildebrand solubility parameter of less than about 8.0 or the complexing solubility parameter of less than 0.5 and a field force parameter of less than 7.5. Suitable non-polar solvents include, e.g., saturated aliphatic hydrocarbons such as pentanes, hexanes, heptanes, paraffinic naphtha, $C_5$-$C_{11}$, kerosene $C_{12}$-$C_{15}$ diesel $C_{16}$-$C_{20}$, normal and branched paraffins, mixtures or any of these solvents. The preferred solvents are $C_5$-$C_7$ paraffins and $C_5$-$C_{11}$ parafinic naphtha.

In accordance with the desportion operations using polar solvent(s), solvents are selected having an overall solubility parameter greater than about 8.5, or a complexing solubility parameter of greater than 1 and field force parameter of greater than 8. Examples of polar solvents meeting the desired minimum solubility parameter are toluene (8.91), benzene (9.15), xylenes (8.85), and tetrahydrofuran (9.52).

Advantageously, the present invention reduces the concentrations of nitrogen-containing compounds, sulfur-containing compounds and PNA compounds in a heavy feedstream to a hydrocracking unit such as a DMO or DAO feedstream. In addition, in recycle hydrocracking operations, the concentration of HPNA compounds that are formed in the unconverted fractionator bottoms is reduced. Accordingly, the overall efficiency of operation of the hydrocracking unit is improved along with the effluent product quality.

Example

Attapulgus clay having the properties set forth in Table 1 was used as an adsorbent to treat a blend of de-metalized oil stream and unconverted hydrocracker bottoms (1:2 ratio). The virgin DMO contained 2.9 W % sulfur and 2150 ppmw nitrogen, 7.32 W % MCR, 6.7 W % tetra plus aromatics as measured by a UV method. The unconverted hydrocracker bottoms was almost free of sulfur (<10 ppmw), nitrogen (<2 ppmw) and contained >3000 ppmw coronene and its derivatives and about 50 ppmw of ovalene. The mid-boiling point of the DMO stream was 614° C. as measured by the ASTM D-2887 method. The unconverted hydrocracker bottoms had much lower mid boiling point (442° C.). The de-metalized oil and HPNA blend was mixed with a straight run naphtha stream boiling in the range of 36° C. to 180° C. containing 97 W % paraffins, the remainder being aromatics and naphthenes at 1:10 V %:V % ratio and passed to the adsorption column containing attapulgus clay at 20° C. The contact time for the mixture was 30 minutes.

The naphtha fraction was distilled off and 94.7 W % of adsorbent treated DMO/unconverted hydrocracker bottoms mixture was collected. The molecules adsorbed on the adsorbent material, was desorbed in two steps. A first desorption step was conducted with toluene, and after distilling the first desorption solvent, the yield was 3.6 W % based on the total weight of the blend feed. A second desorption step was conducted with tetrahydrofuran, and after distilling the second desorption solvent, the yield was 2.3 W % based on the initial feed. After the treatment process, 75 W % of nitrogen-containing compounds, 44 W % of MCR and 2 W % of sulfur-containing compounds were removed from the blend sample. 95 W % of the HPNA was also removed from the blend.

The treated de-metalized oil and unconverted hydrocracker bottoms were hydrocracked using a stacked-bed reactor. Using the treated de-metalized oil and unconverted hydrocracker bottoms according to the process herein, the hydrocracking reactions occurred with a decrease in 10° C. in reactivity temperature as compared to untreated oil as shown in Table 2, thereby indicating the effectiveness of the feedstream treatment process of the invention. Table 3 shows product yields for both configurations The reactivity, which can be translated into longer cycle length for the catalyst, can result in at least one year of additional cycle length for the hydrocracking operations, processing of a larger quantity of feedstream, or processing of heavier feedstreams by increasing the de-metalized oil content of the total hydrocracker feedstream. In addition, the treatment of unconverted hydrocracker bottoms stream resulted in clean recycle stream and eliminated the indirect recycle to the vacuum tower or other separation units such as solvent de-asphalting.

TABLE 1

| Property | Unit | Attapulgus Clay |
|---|---|---|
| Surface Area | $m^2/g$ | 108 |
| Pore Size | °A | 146 |
| Pore Size Distribution | °A-cc/g | 97.1 |
| Pore Volume | cc/g | 0.392 |
| Carbon | W % | 0.24 |
| Sulfur | W % | 0.1 |
| Arsenic | ppmw | 55 |
| Iron | ppmw | 10 |
| Nickel | W % | 0.1 |
| Sodium | ppmw | 1000 |
| Loss of Ignition @500° C. | W % | 4.59 |

TABLE 2

| Feedstream | VGO/DMO Blend No Treatment | VGO/DMO Blend With treated DMO Treatment |
|---|---|---|
| VGO/DMO Ratio | 85:15 | 85:15 |
| Temperature | 398° C. | 388° C. |
| Pressure | 115 Kg/cm2 | 115 Kg/cm2 |
| Hydrogen to Oil Ratio | 1,500 | 1,500 |
| LSHV | 0.70 h−1 | 0.70 h−1 |
| Catalyst 1 | Ni—W on Silica Alumina | Ni—W on Silica Alumina |
| Catalyst 2 | Ni—W on Zeolite | Ni—W on Zeolite |
| Catalyst 1/Catalyst 2 V:V % | 3:1 | 3:1 |
| Overall Conversion of 370° C.+ Hydrocarbons, W % | 95 | 95 |
| Recycle of 370° C.+, W % | 15 | 15 |
| Bleed of 370° C.+ Hydrocarbons, W % | 0 | 0 |

TABLE 3

| Feedstream | VGO/DMO Blend No Treatment | VGO/DMO Blend With treated DMO Treatment |
|---|---|---|
| Light Naphtha | 20.01 | 22.02 |
| Heavy Naphtha 85-185° C. | 39.64 | 37.34 |
| Kerosene 185-240° C. | 8.68 | 8.58 |
| Light Diesel Oil 240-315° C. | 6.41 | 6.42 |
| Heavy Diesel Oil 315-375° C. | 4.42 | 4.56 |
| Bottoms 375-FBP ° C. | 20.84 | 21.07 |

The method and system of the present invention have been described above and in the attached drawings; however, modifications will be apparent to those of ordinary skill in the art and the scope of protection for the invention is to be defined by the claims that follow.

I claim:

1. A hydrocracking process for treating a first heavy hydrocarbon feedstream and a second heavy hydrocarbon feedstream, the first heavy hydrocarbon feedstream contains undesired nitrogen-containing compounds and poly-nuclear aromatic compounds, the process comprising:

a. contacting the first heavy hydrocarbon feedstream and elution solvent with an effective amount of adsorbent material to produce an effluent comprising solvent and an adsorbent-treated heavy hydrocarbon stream having a reduced content of nitrogen-containing and poly-nuclear aromatic compounds, and recovering solvent from the effluent;

b. combining the second heavy hydrocarbon feedstream with the adsorbent-treated heavy hydrocarbon stream;

c. introducing the combined stream and an effective amount of hydrogen into a hydrocracking reaction unit that contains an effective amount of hydrocracking catalyst to produce a hydrocracked effluent stream;

d. fractionating the remainder of the hydrocracked effluent stream to recover hydrocracked products and a bottoms stream containing heavy poly-nuclear aromatic compounds;

e. contacting the fractionator bottoms stream with an effective amount of adsorbent material to produce an adsorbent-treated fractionator bottoms stream having a reduced content of heavy poly-nuclear aromatic compounds;

f. integrating the adsorbent-treated fractionator bottoms stream with the combined stream of steps (b); and g. introducing the combined stream into the hydrocracking reaction unit.

2. The process of claim 1, further comprising removing any excess hydrogen from the hydrocracked effluent stream and recycling it back to the hydrocracking reaction zone.

3. The process of claim 1, wherein the adsorbent material in step (a) is the same as the adsorbent material in step (e), which are both maintained in an adsorption zone.

4. The process of claim 3, wherein the fractionator bottoms and the first liquid hydrocarbon feedstream are combined upstream of the adsorption zone.

5. The process of claim 1, wherein the adsorbent material in step (a) is different from the adsorbent material in step (e), which are maintained in separate adsorption zones.

6. The process of claim 1, wherein the first heavy hydrocarbon feedstream is selected from the group consisting of de-metalized oil, de-asphalted oil, coker gas oils, heavy cycle oils, and visbroken oils.

7. The process of claim 1, wherein the second heavy hydrocarbon feedstream is vacuum gas oil.

8. The process of claim 1, wherein the adsorbent material in step (a), step (e) or both steps (a) and (e) is packed into the at least one fixed bed column and is in the form of pellets, spheres, extrudates or natural shapes and the size is in the range of 4 mesh to 60 mesh.

9. The process of claim 1, wherein the adsorbent material in step (a), step (e) or both steps (a) and (e) is selected from the group consisting of attapulgus clay, alumina, silica gel, activated carbon, fresh catalyst and spent catalyst.

10. The process of claim 4 which further comprise:

h. passing the fractionator bottoms and the first liquid hydrocarbon feedstream through a first of two packed columns;

i. transferring the fractionator bottoms and the first liquid hydrocarbon feedstream from the first column to the second column while discontinuing passage through the first column;

j. desorbing and removing nitrogen-containing compounds, poly-nuclear aromatic compounds and heavy poly-nuclear aromatic compounds from the adsorbent material in the first column to thereby regenerate the adsorbent material;

j. transferring the fractionator bottoms and the first liquid hydrocarbon feedstream from the second column to the first column while discontinuing the flow through the second column;

l. desorbing and removing nitrogen-containing compounds, poly-nuclear aromatic compounds and heavy poly-nuclear aromatic compounds from the adsorbent material in the second column to thereby regenerate the adsorbent material; and m. repeating steps (h)-(l), whereby the processing of the fractionator bottoms and the first liquid hydrocarbon feedstream is continuous.

11. The process of claim 5 which further comprises:

h. passing the first liquid hydrocarbon feedstream through a first of two packed columns;

i. transferring the first liquid hydrocarbon feedstream from the first column to the second column while discontinuing passage through the first column;

j. desorbing and removing nitrogen-containing compounds and poly-nuclear aromatic compounds from the adsorbent material in the first column to thereby regenerate the adsorbent material;

k. transferring the first liquid hydrocarbon feedstream from the second column to the first column while discontinuing the flow through the second column;

l. desorbing and removing nitrogen-containing compounds and poly-nuclear aromatic compounds from the adsorbent material in the second column to thereby regenerate the adsorbent material; and m. repeating steps (h)-(l), whereby the processing of the first liquid hydrocarbon feedstream is continuous.

12. The process of claim 5 which further comprises:

h. passing the fractionator bottoms through a first of two packed columns;

i. transferring the fractionator bottoms from the first column to the second column while discontinuing passage through the first column;

j. desorbing and removing heavy poly-nuclear aromatic compounds from the adsorbent material in the first column to thereby regenerate the adsorbent material;

k. transferring the fractionator bottoms from the second column to the first column while discontinuing the flow through the second column;

l. desorbing and removing heavy poly-nuclear aromatic compounds from the adsorbent material in the second column to thereby regenerate the adsorbent material; and m. repeating steps (h)-(l), whereby the processing of the fractionator bottoms is continuous.

13. The process of claim 1, further in which the first heavy hydrocarbon feedstream is mixed with solvent prior to contacting in step (a).

14. The process of claim 1, further in which the fractionator bottoms stream is mixed with solvent prior to contacting in step (e).

15. The process of claim 4, further in which the combined fractionator bottoms and the first liquid hydrocarbon feedstream is mixed with the elution solvent prior to contacting with adsorbent material.

16. The process of claim 1, further comprising removing a portion of the fractionator bottoms stream as a bleed stream, and contacting the remainder of the fractionator bottoms stream as in step (e).

17. The process of claim 1, wherein the elution solvent comprises naphtha.

18. The process of claim 1, wherein the elution solvent comprises naphtha derived from hydrocracked products recovered in step (d).

* * * * *